US006551130B2

(12) United States Patent
Bonilla

(10) Patent No.: US 6,551,130 B2
(45) Date of Patent: Apr. 22, 2003

(54) 4×8 FIRE RATED POKE THROUGH FITTING

(75) Inventor: Nelson Bonilla, West Haven, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/779,450

(22) Filed: Feb. 9, 2001

(65) Prior Publication Data

US 2002/0111062 A1 Aug. 15, 2002

(51) Int. Cl.[7] ..... H01R 13/60

(52) U.S. Cl. ..... 439/535; 439/650; 439/652; 174/48

(58) Field of Search ..... 439/535, 650, 439/652; 174/48; D13/139.5

(56) References Cited

U.S. PATENT DOCUMENTS

| | | | |
|---|---|---|---|
| 1,318,733 | A | 12/1924 | Eckstein |
| 1,717,836 | A | 6/1929 | Conner |
| 4,243,835 | A | 1/1981 | Ehrenfels |
| 4,266,266 | A | 5/1981 | Sanner |
| 4,323,724 | A | 4/1982 | Shine |
| 4,336,416 | A | 6/1982 | Goodsell |
| 4,433,204 | A | 2/1984 | Wuertz |
| 4,477,694 | A | 10/1984 | Kohaut |
| 4,496,790 | A | 1/1985 | Spencer |
| 4,583,799 | A | 4/1986 | Wiley |
| 4,770,643 | A | 9/1988 | Castellani et al. |
| 4,827,080 | A | 5/1989 | Castellani et al. |
| 4,978,318 | A | 12/1990 | Wiley et al. |
| 4,993,970 | A | 2/1991 | Littrell |
| 5,003,127 | A | 3/1991 | Sosinski et al. |
| 5,008,491 | A | 4/1991 | Bowman |
| 5,032,690 | A | 7/1991 | Bloom |
| 5,064,969 | A | 11/1991 | Bloom |
| 5,102,355 | A | 4/1992 | Murphy et al. |
| 5,107,072 | A | 4/1992 | Morgan |
| 5,121,594 | A | 6/1992 | Wuertz |
| 5,124,876 | A | 6/1992 | Misencik et al. |
| 5,135,411 | A | 8/1992 | Wiley et al. |
| 5,220,131 | A | 6/1993 | Wuertz |
| 5,237,128 | A | 8/1993 | Wuertz |
| 5,272,278 | A | 12/1993 | Wuertz |
| 5,281,172 | A | 1/1994 | Luu |
| 5,393,930 | A | 2/1995 | Wuertz |
| 5,410,103 | A | 4/1995 | Wuertz |
| 5,422,434 | A | 6/1995 | Wuertz et al. |
| 5,460,542 | A | 10/1995 | Castellani et al. |
| 5,486,121 | A | 1/1996 | Miller |

(List continued on next page.)

FOREIGN PATENT DOCUMENTS

| | | |
|---|---|---|
| FR | 1116385 | 5/1954 |

OTHER PUBLICATIONS

Walker Catalog, RCI™ RC900 Series Quad Poke–Thru, 1997.

Wiremold Catalog, RC4 Flush Quad Poke–Thru Series, 2000.

Hubbell Premise Wiring, Inc., Catalog #1100R, published prior to Oct. 1998, pp. 122 and 133.

Hubbell Wiring Devices & Systems–Kellems Wire Management–Marine Wiring Products Catalog #2000, 1995, pp. K–17 and K–80 through K–88.

*Primary Examiner*—Tho D. Ta
(74) *Attorney, Agent, or Firm*—Jeffrey J. Howell; Mark S. Bicks; Alfred N. Goodman

(57) ABSTRACT

A poke through fitting extending through an aperture in a floor, comprising a housing having a top surface, a portion of the housing received within the aperture in the floor. At least three electrical outlets are received within the housing, each of the outlets being accessible through at least one access opening in the top surface of the housing. Additionally, at least five telecommunication jacks are coupled to the housing.

31 Claims, 5 Drawing Sheets

U.S. PATENT DOCUMENTS

| | | | | | |
|---|---|---|---|---|---|
| 5,601,455 | A | | 2/1997 | Bagga | |
| D389,459 | S | | 1/1998 | Byrne | |
| 5,747,732 | A | | 5/1998 | Bera et al. | |
| 5,763,826 | A | | 6/1998 | Castellani et al. | |
| D399,826 | S | | 10/1998 | Byrne | |
| D408,355 | S | | 4/1999 | Welsh et al. | |
| D409,980 | S | | 5/1999 | Byrne | |
| 6,042,426 | A | * | 3/2000 | Byrne | 439/654 |
| 6,114,623 | A | * | 9/2000 | Bonilla et al. | 439/650 |

* cited by examiner

4×8 FIRE RATED POKE THROUGH FITTING

FIELD OF INVENTION

The present invention relates to a poke through floor fitting that enables access to both electrical outlets and telecommunication connections. More specifically, the present invention relates to a fire-rated poke through floor fitting for use in a four-inch diameter bore that has four electrical outlets and eight telecommunication jacks while maintaining a low profile.

BACKGROUND OF INVENTION

Typically, fire-rated poke through fittings provide a housing for electrical outlets and/or telecommunication jacks. Generally, these poke through fittings are mounted in a core-drilled, approximately three or four inch diameter hole, which is commonly formed in a concrete floor.

Only a limited number of holes can be drilled in a given concrete floor, while maintaining the floor's structural integrity. For example, some codes require only one through hole for every 65 square feet of floor. Therefore, it is important that each fitting provide the maximum number of electrical outlets and/or telecommunication jacks.

In addition, due to the three or four inch diameter of the bore used for the typical poke through fittings, the size of the typical fitting is inherently constrained, especially if it is desirable to keep the fitting as close to the floor as possible, i.e., if it is advantageous to keep the fitting relatively flat with a low profile. The consistently increasing need for additional electrical outlets and telecommunication access at each workstation has made the prior art fittings deficient due to the limited number of electrical outlets and the limited amount of telecommunication access. This is especially true when a low profile, but easily accessible fitting is desired. Prior art fittings are also deficient in that they require complicated bus bar configurations due to the limited space within the fitting.

Examples of prior art fittings are disclosed in the following U.S. patents: U.S. Pat. No. 4,770,643 to Castellani et al.; U.S. Pat. No. 4,323,724 to Shine; U.S. Pat. No. 5,008,491 to Bowman; U.S. Pat. No. 5,442,434 to Wuertz et al.; U.S. Pat. No. 5,393,930 to Wuertz; U.S. Pat. No. 5,272,278 to Wuertz; U.S. Pat. No. 5,237,128 to Wuertz; U.S. Pat. No. 5,220,131 to Wuertz; U.S. Pat. No. 5,121,594 to Wuertz; U.S. Pat. No. 4,433,204 to Wuertz; U.S. Pat. No. 4,336,416 to Goodsell; U.S. Pat. No. 4,243,835 to Ehrenfels; U.S. Pat. No. 5,410,103 to Wuertz; U.S. Pat. No. 4,496,790 to Spencer; U.S. Pat. No. 4,922,668 to Payne; U.S. Pat. No. 4,266,266 to Sanner; U.S. Pat. No. 5,460,542 and U.S. Pat. No. 5,763,826 to Castellani et al.; and U.S. Pat. No. 4,583,799 to Wiley the disclosures of which are incorporated herein by reference.

SUMMARY OF THE INVENTION

Accordingly, an object of the present invention is to provide an improved fire-rated poke through floor fitting with a relatively large number of electrical outlets and/or telecommunication jacks.

Another object of the present invention is to provide a poke through floor fitting capable of limiting the transfer of heat, smoke and flame from a fire therethrough, while still allowing numerous electrical wires to pass through the fitting.

Yet another object of the present invention is to provide a poke through floor fitting about the same size as the aperture in the floor and still prevent heat, smoke and flame from a fire from passing through the fitting.

Still another object of the present invention is to provide a poke through floor fitting that allows access to four electrical outlets and eight telecommunication jacks through the aperture in the floor while maintaining a low profile.

The foregoing objects are basically obtained by providing a poke through fitting extending through an aperture in a floor, comprising a housing having a top surface, a portion of the housing received within the aperture in the floor, at least three electrical outlets received within the housing, each of the outlets being accessible through at least one access opening in the top surface of the housing and at least five telecommunication jacks coupled to the housing.

By forming a poke through fitting according to the present invention, the fitting is able to fit a large number of both electrical outlets and telecommunication jacks into an aperture in a floor while still maintaining the size limitations for existing apertures. Additionally, by forming a poke through according to the present invention, it is not necessary to create as many holes in a floor as required in the past to allow access to the same number of telecommunication jacks and electrical outlets.

Other objects, advantages and salient features of the invention will become apparent from the following detailed description which, taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE PREFERRED EMBODIMENT

Figure 1:
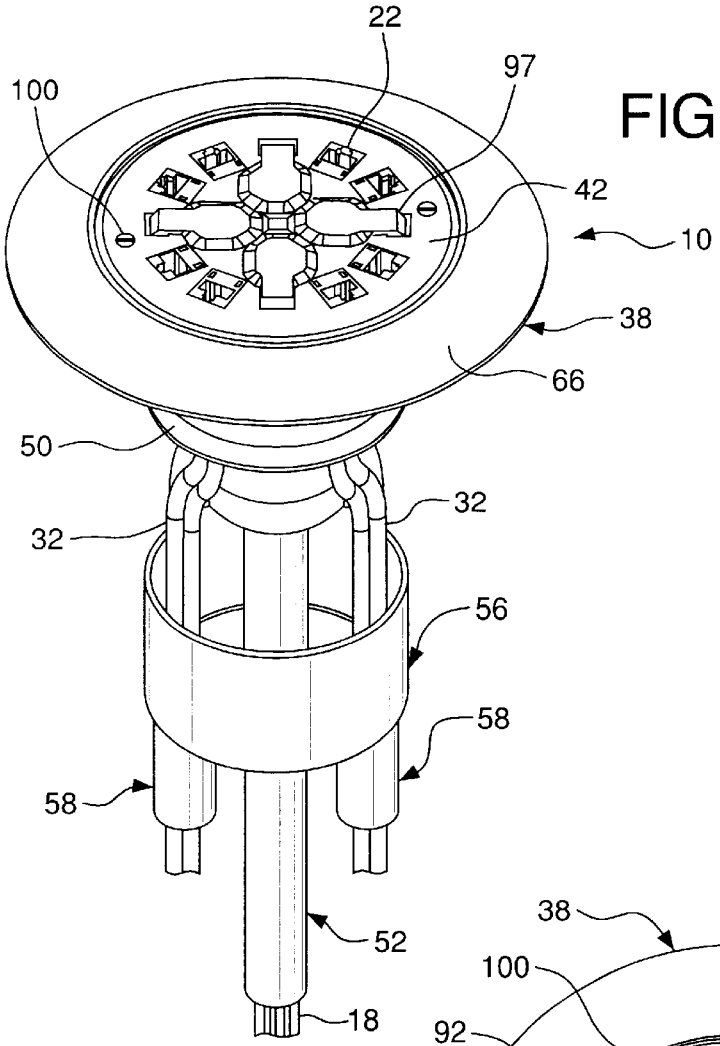
FIG. 1 is a top perspective view of a poke through floor fitting in accordance with the preferred embodiment of the present invention.

FIGS. 1–6 illustrate a fitting 10 in accordance with a preferred embodiment of the present invention. Fitting 10 is a fire-rated, poke through floor fitting. When assembled, fitting 10 is preferably intended to be inserted into an opening or aperture 12 formed in a concrete floor 14. Fitting 10 preferably has an outer or external diameter C that is substantially the same size as or slightly less than diameter D of cylindrical surface 16 of aperture 12, but may be any size desired. The fitting 10 provides easy access for electrical wires 18 or telecommunication wires 32 to pass through the floor to the four electrical outlets 20*a–d* or eight telecommunication jacks 22 mounted therein or coupled thereto. Preferably, fitting 10 provides access to four electrical outlets and eight telecommunication jacks or other types of electrical devices; but may provide as many jacks or outlets as desired. The fitting 10 provides access through floor 14 and on top of any flooring 24, such as carpeting, which is placed on top of floor 14.

Although fitting 10 is illustrated with a concrete floor 14, fitting 10 can be used in any surface containing an opening capable of receiving fitting 10, such as a concrete slab or deck or any other surface. Preferably fitting 10 is inserted into an opening 12 that is substantially circular and generally has a diameter of about four inches, but may be inserted into any size aperture desired. Fitting 10 is generally inserted from first side 26 of floor 14 through opening 12 to second side 28 of floor 14. However, fitting 10 may be inserted in any manner desired.

Figure 6:
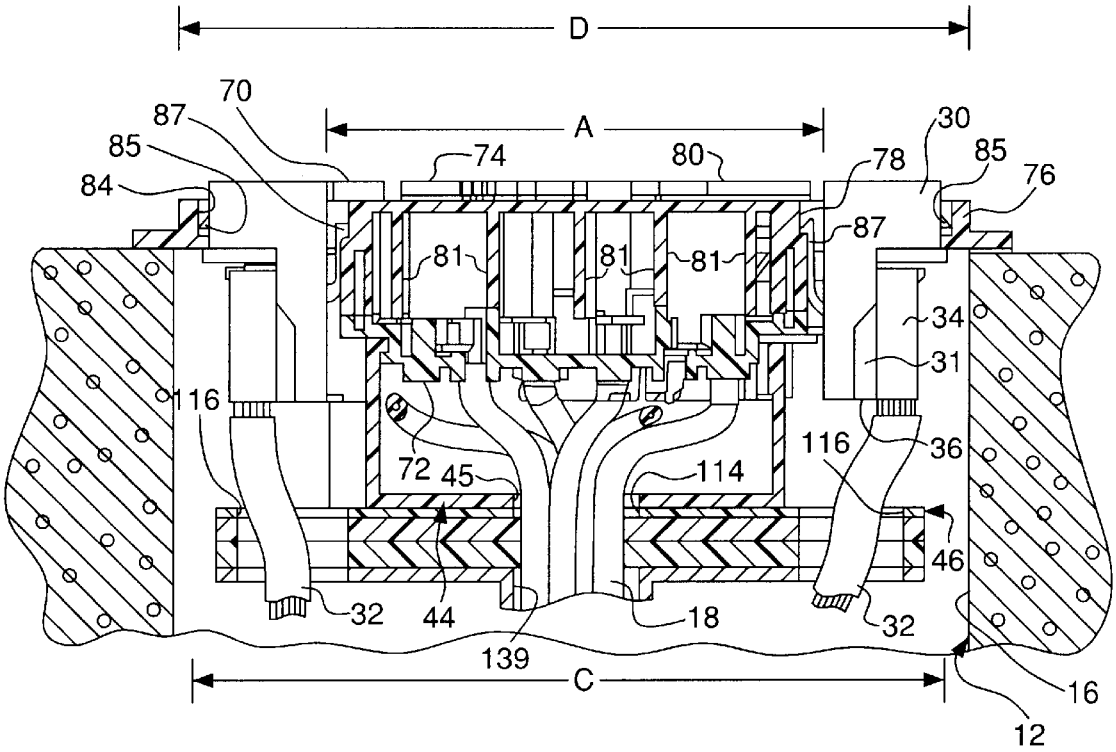
FIG. 6 is a partial cross-sectional side view taken along line 6—6 of FIG. 5.
Figure 9:
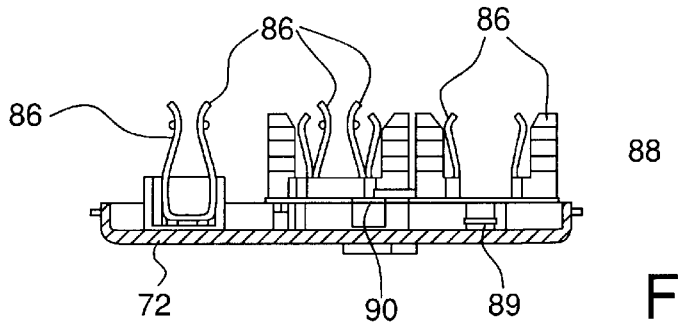
FIG. 9 is a cross-sectional side view taken along line 9—9 of FIG. 8.
Figure 10:
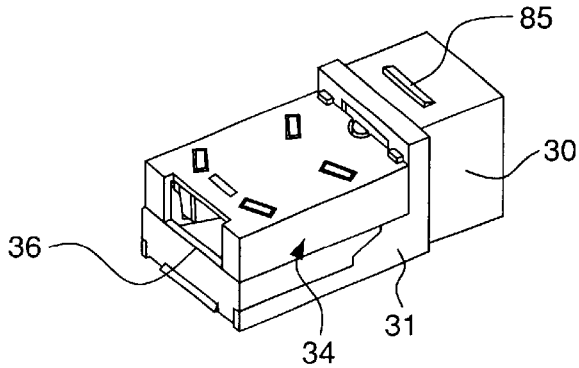
FIG. 10 is a top perspective view of the telecommunication jack for the poke through fitting of FIG. 1.

Electrical outlets 20*a–d* are preferably standard outlets for providing power to any electrical device and telecommunication jacks 22 are preferably RJ-45 HUBBELL PREMISE WIRING jacks for Category 3, 5, SE, or 6 electrical connectors. However, jacks 22 can be any type of jacks for any electrical or non-electrical device or devices, such as a computer, telephone, or facsimile machine, and can include metallic or glass wires, such as copper wires and fiber optic cables. HUBBELL PREMISE WIRING jacks are specifically preferred, since as seen in FIGS. 6 and 9, the front portion or plug connection portion 30 has a larger cross-sectional area then the back portion or insulation displacement contacts (DC) portion 31 taken in a direction substantially perpendicular to the direction in which a plug (not shown) is inserted. Additionally, the telecommunication wires 32 extend from underneath the stuffer cap 34 out the back 36 of the jack 22. These two specific features allow jack 22 to have a relatively low profile or height compared to conventional jacks, thus allowing a high number of jacks to be placed in the poke through fitting while still remaining within a suitable radius. In other words, the jack is only as large as necessary to couple with a plug and since the wires extend out of the back 36, the wires 32 will not interfere with surface 16. For a more detailed description of the HUBBELL PREMISE WIRING jack, see commonly owned U.S. patent application Ser. Nos. 09/250,186 and 09/675,652, both of which are incorporated herein by reference.

Fitting 10 is formed of a flange 38, a receptacle assembly 40, cover 42, an insulator 44, a bracket or floor cup 46, positioning clips 48, intumescent rings or collars 50, a wiring tube 52, intumescent rings or collars 54, a lower cup 56 and telecom conduits 58.

Figure 3:
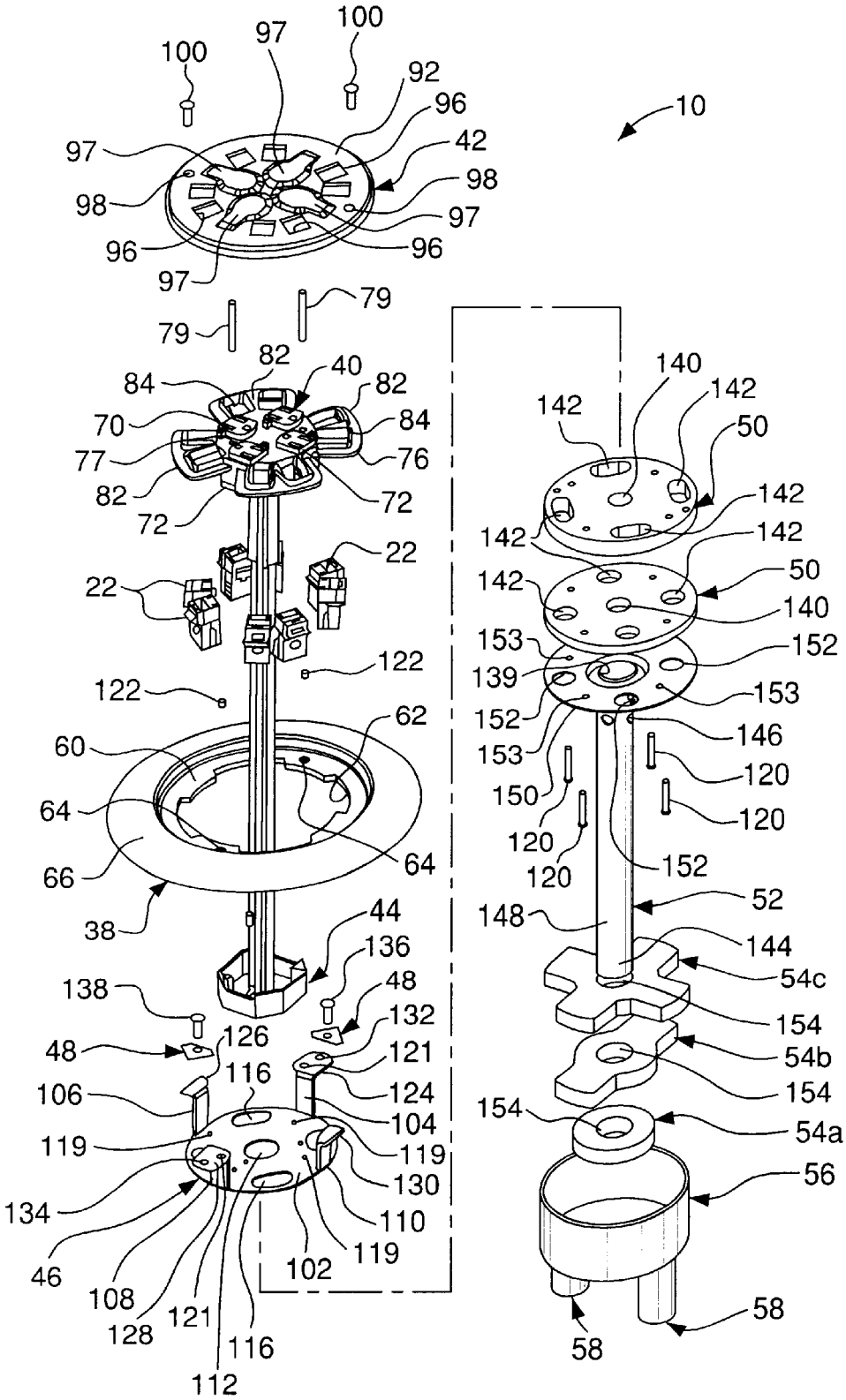
FIG. 3 is an exploded top perspective view of the poke through fitting of FIG. 1.
Figure 4:
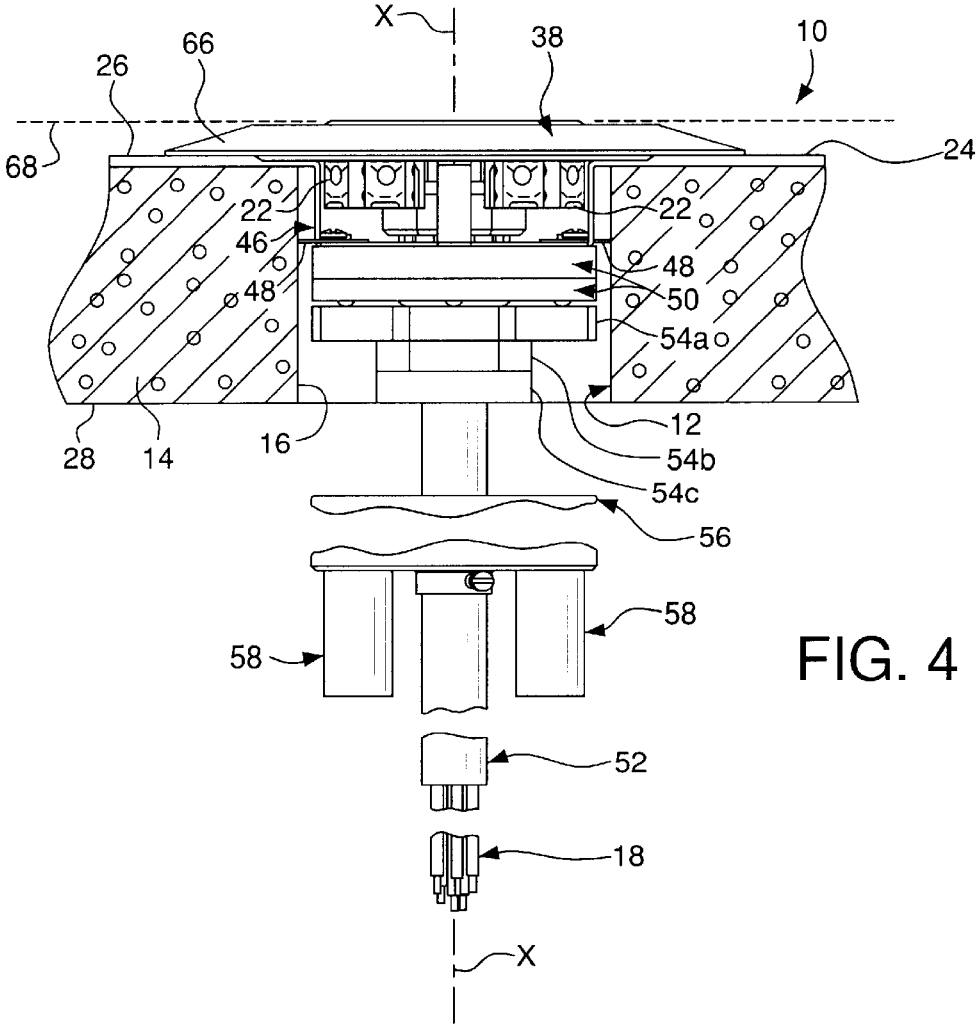
FIG. 4 is a partial side view of the poke through fitting of FIG. 1 received into an aperture in a floor.

As seen in FIGS. 3 and 4, flange 38 is a preferably substantially circular aluminum or brass member (or any other suitable metal or non-metal) that rests on floor 14 or flooring 24. Flange 38 has a depressed inner portion 60 with an access opening 62 and holes 64. Flange 38 has an outer portion 66 extending from inner portion 60 in an inclined manner to provide a gradual increasing of fitting 10 in from flooring 14 to approximately the height of the outlets 20*a–d* and jacks 22. Also, the uppermost portion of flange 38 is substantially flush with plane 68, preferably with a total vertical height of approximately or less than 0.6 inches or more preferably about ½ inch. Thus, the height of the plane 68, or the uppermost portion of flange 38 can be approximately ½ inch. This relatively low height results in a low profile for fitting 10 which is aesthetically pleasing and is less of an obstruction to those walking or working on floor 14 or to the furniture on floor 14.

Figure 7:
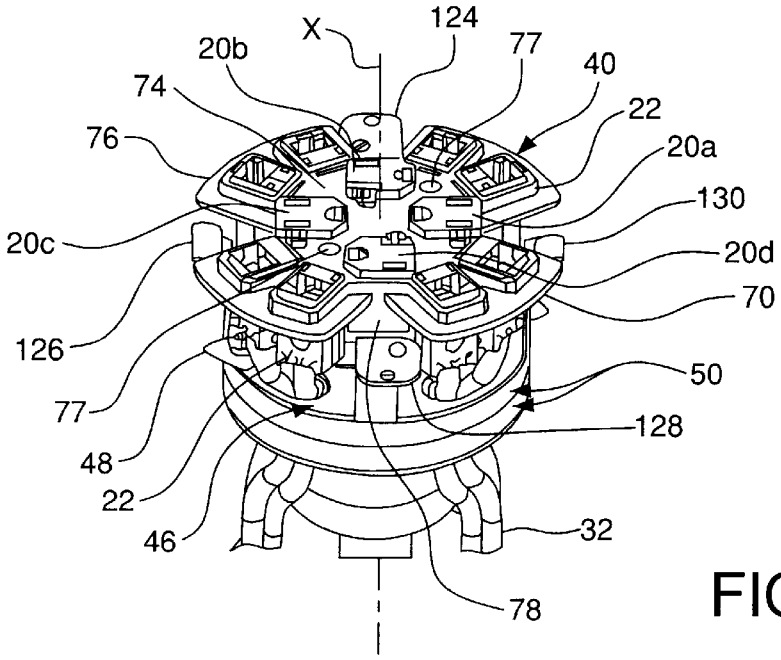
FIG. 7 is a perspective top view of the poke through fitting of FIG. 5.

As seen in FIGS. 6 and 7, receptacle assembly or housing 40 is preferably a plastic molded two-piece housing that has a top or first portion 70, a bottom or second portion 72, and a central axis X. However, the housing can be made of any suitable material or have any suitable configuration with any number of pieces. Top portion 70 has an inner portion 74 and an outer portion 76.

Figure 5:
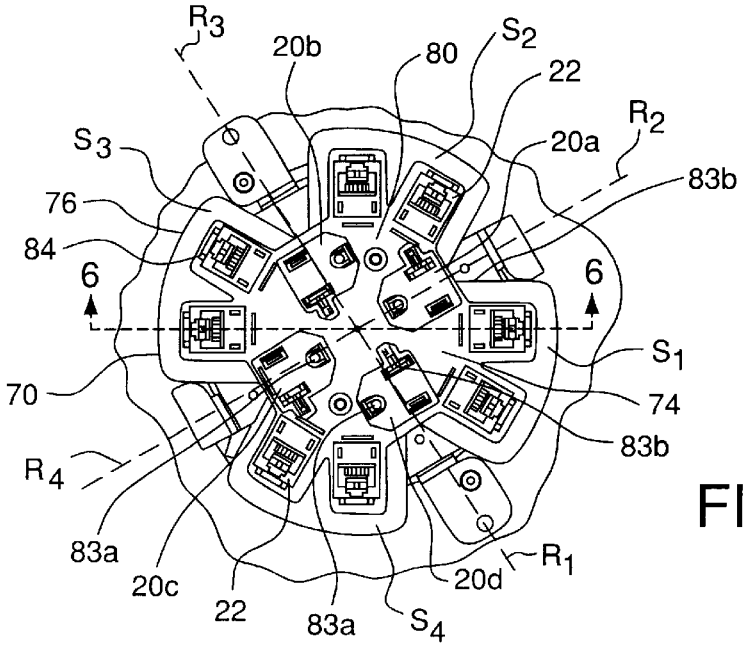
FIG. 5 is top view of the poke through fitting of FIG. 1 with the flange and cover removed therefrom.

As seen in FIGS. 5 and 6, inner portion 74 is preferably molded and generally circular with a diameter A. Inner portion 74 has an outer surface or exterior wall 78, top surface 80 and apertures 83*a* and 83*b* that are for access to four electrical outlets 20*a*, 20*b*, 20*c* and 20*d* in top surface 80 that are arranged in a substantially circular array with the center of the circular array substantially coordinating with the center of the fitting 10 or central axis X. Outlets 20*a–b* are each preferably located within inner portion 74 but may only have a portion of the outlet located therein. Top surface 80 also has apertures or holes 77 for screws 79. As seen specifically in FIG. 5, the apertures for outlets 20*a* and 20*c* are configured radially, while outlets 20*b* and 20*d* are configured tangentially. That is, the grounding portion 83*a* of the outlet in outlets 20*a* and 20*c* is closer to the center than the hot and neutral portions 83*b* of the outlet, with the hot and neutral portions 83*b* extending generally parallel to a line drawn from the center of the top portion 70 to the outer surface 78, and the neutral and hot portions 83*b* of outlets 20*b* and 20*d* are generally tangential with outer surface 78. Configuring the outlets in this manner allows an electrical plug to be plugged in various directions without interference from other plugs. For example, many plugs have transformers or other extensions thereon, which may interfere with other plugs if the all the outlets were in a radial configuration. The above described configuration allows the large sized plugs to be angled away from at least two of the plugs, thus leaving more space for additional plugs. However, the outlets may be configured in any manner desired, such as all outlets extending radially with the grounding portion either closer to or farther away from the center of the top portion than the hot and neutral portions or all outlets tangential, as described above, or any other configuration desired or combination of configurations (i.e. thee outlets tangential and one outlet radial or visa versa).

Figure 2:
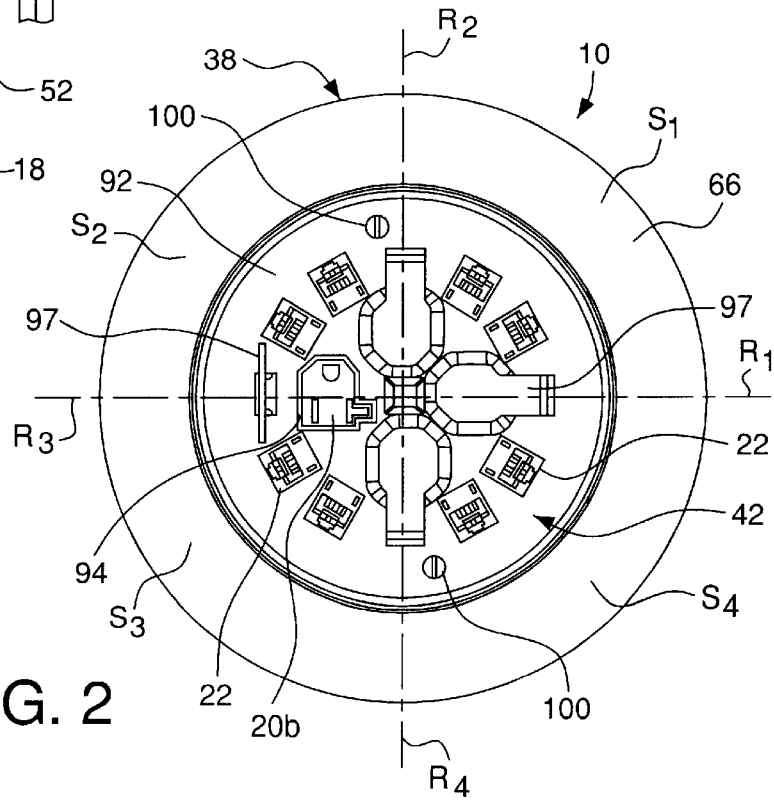
FIG. 2 is a top view of the poke through fitting of FIG. 1, with one of the lids opened.

As seen in FIGS. 2 and 5, radial lines $R_1$, $R_2$, $R_3$ and $R_4$ extend in a direction from the center of fitting 10 (axis X) through outlets 20*a–d*, respectively, dividing fitting 10 or top surface 80 into four different segments, $S_1$, $S_2$, $S_3$ and $S_4$. Each segment is preferably approximately 90 degrees, but may be any size desired. Preferably each respective radial line extends through the approximate center of outlets 20*a–d*, but may extend through any portion of the outlets or top surface 80. In between each two adjacent outlets and located in each of the four segments are at least two telecommunication jacks. The jacks are preferably located within the segment in the outer portion 76 but may be located in the inner portion 74 or a portion of each jack may be located in each of the outer and inner sections.

As seen specifically in FIG. 6, inner portion 74 extends farther downwardly relative to outer portion 76 and is partially situated in aperture 12. This allows a portion of each outlet to be received within the aperture 12, thereby allowing the poke through 10 to extend only about ½ inch above the floor.

Additionally, the interior of the inner portion 74 of the top portion 70 has walls 81 that extend substantially perpendicularly to top surface 80 that separate the electrical contacts of the outlets from one another.

As seen in FIGS. 3 and 5–7, outer portion 76 extends radially outwardly from outer surface 78 of inner portion 74. Outer portion 76 preferably comprises four radially extending, coplanar extensions 82 that each has two apertures or holes 84 extending therethrough. Apertures 84 are preferably keystone envelopes, which are generally rectangular openings in housings or electrical faceplates for coupling RJ-45 jacks or any other telecommunication jacks therein. Advantageously, as seen in FIGS. 1–7, apertures 84 and jacks 22 are arranged in a substantially circular array substantially concentric to the circular array of outlets 20*a–d* and spaced radially farther from the center of the fitting 10 or the central axis X than the circular array of outlets. Preferably, as seen in FIG. 5, the inner edge of the circular array of jacks substantially coincides with the outer edge of the circular array of outlets and the central axis X. Generally, jacks 22 couple to the envelope using a protrusion 85 and a latching mechanism 87, as seen in FIGS. 6 and 9. However, apertures 84 can be any size and configuration desirable and jacks 22 can couple thereto in any way desirable. Additionally, the jacks 22 do not necessarily need to couple within an aperture and may couple to outer surface 78 if extensions 82 do not exist, or the jacks can couple to the extensions so that only a portion of the jack is adjacent the outer portion. For example, the apertures 84 can be a grove or slot in the extensions 82.

Each extension 82 is generally equidistant from the adjacent two extensions and are arranged around or extend or protrude radially outwardly from the perimeter of outer surface 78 of inner portion 74 in a substantially circular configuration that has a diameter that is generally larger than the diameter of aperture 12, as seen in FIG. 6. As seen in FIG. 5, the jacks 22 are preferably situated radially around the outlets 20*a–d,* with the outlets set closer to the center of top portion 70 than the jacks 22. Extensions 82 are preferably relatively low profile and can fit within inner portion 60 of flange 38, resting thereon. By configuring the jacks in this manner a portion of each jack can be received within the aperture, thereby allowing the poke through fitting 10 to extend only about ½ inch above the floor.

Figure 8:
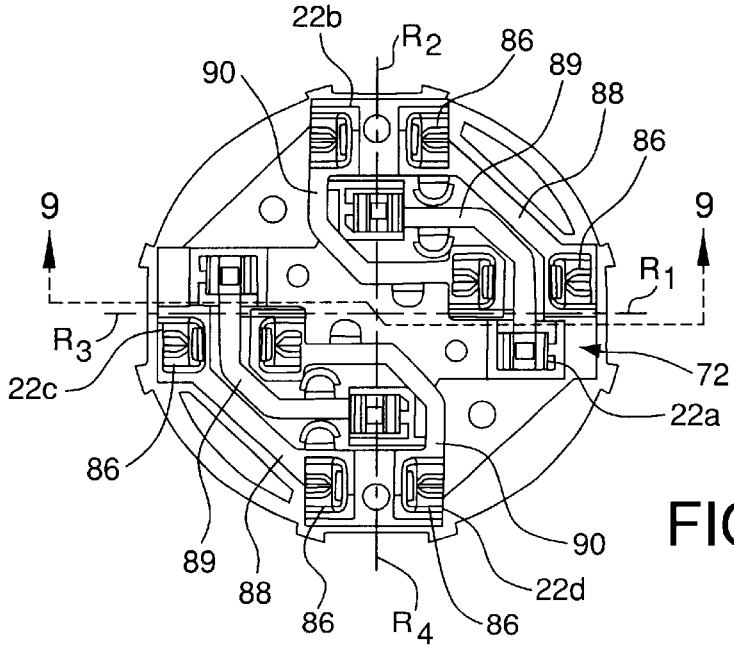
FIG. 8 is a top view of the bus bars for the electrical outlets that are located in the housing of the fitting shown in FIGS. 1–7.

The bottom portion 72, as seen in FIGS. 8 and 9, is preferably a molded plastic, generally circular piece that holds the electrical contacts 86 and bus bars 88, 89 and 90 for the electrical outlets. Preferably the bus bars do not overlap. That is, each bus bar 88, 89 and 90 is spaced from each other bus bar as viewed when looking down onto bottom portion 72 in the direction of insertion of the electrical plugs (not shown) or when viewing FIG. 8. Therefore, during assembly the bus bars 88, 89 and 90 can be inserted into bottom portion 72 in any order; thus, facilitating assembly of the poke through fitting 10.

Each pair of outlets 22*a* and *b* and 22*c* and *d* is substantially identical so only outlet pair 22*a*–will be discussed in detail. The pair of outlets 22*a–b* includes an outer bus bar 88, a middle bus bar 89, and an inner bus bar 90. In forming the second pair of outlets 22*c–d,* bus bars 88, 89, and 90 are merely rotated 180 degrees about the central axis of bottom portion 72 and used as bus bars in a substantially identical manner as with the pair of outlets 22*a–b*. Of course, this saves in manufacturing costs since only three types of bus bars need be manufactured for the six bus bars required for a full assembly of two pairs of outlets.

As seen in FIG. 9, although bus bars 88, 89, and 90 are generally planar, bottom portion 72 is constructed to permit bus bars 88 and 90 to occupy one plane, while bus bar 89 occupies a second plane, which is parallel to but spaced from the plane of bus bars 88 and 90. This permits additional spacing of bus bar 89 from bus bars 88 and 90.

All bus bars 88, 89, and 90 are positioned on bottom portion 72 with only the wires 18 extending through the bottom portion 72, as seen in FIG. 6. For a more detailed discussion of the various types of bus bars and outlet configuration, see commonly owned U.S. patent application Ser. Nos. 09/481,568 and 09/432,421, both of which are herein incorporated by reference.

As seen in FIG. 3, cover 42 is formed of plastic material and is inserted into the depression formed by inner portion 60 of flange 38. Preferably cover 42 is generally circular in shape with an outer diameter that is slightly smaller than the inner diameter of the inner portion 60 of flange 38. Cover 42 has a top planar surface 92 that lies in plane 68, as seen in FIG. 4, which is substantially parallel to the top surface of flooring 24 and floor 14. As seen in FIG. 2, top planar surface 92 has outlet openings 94, which allow access by an electrical plug (not shown) into each of the electrical outlets 20*a–d.* Also, top planar surface 92 has eight jack openings 96 to allow telecommunication plugs (not shown) to access jacks 22.

Each outlet opening 94 has a hinged lid 97 attached adjacent thereto. Each hinged lid 97 is coupled to the cover in any conventional manner and may be biased closed or toward the cover by a spring or other device. Additionally, each lid 97 substantially covers a single outlet opening 94 and lies substantially parallel to top planar surface 92. Cover 42 also has holes 98 for receiving screws 100 for rigidly securing cover 42 on flange 38.

As seen in FIGS. 1 and 4, the top planar surface 92 is substantially flush with plane 68. Also, the top of each jack 22 and the top of each outlet 20*a–d* is substantially flush with or slightly below plane 68 and surface 92. Preferably, each of the outlets 20*a–d* and the jacks 22 have an upper surface that does not extend above plane 68 or planar surface 92 so that a smooth profile may be maintained by poke through fitting 10. In other words, upper portions or surfaces of the electrical outlets and telecommunication jacks are contained in substantially the same plane as plane 68. This configuration of the smooth, low profile poke through fitting 10 allows for a more aesthetically pleasing appearance and is less of an obstruction for those walking or working on or around an unused poke through fitting 10, with lids 97 in the closed position. However, the outlets and jacks may extend slightly above plane 68, if desired.

Insulator 44 is a preferably a plastic box-like member, which is rigidly coupled to the top of bracket 46 by a screw (not shown) or any other method. Insulator 44 has a bottom opening 45 for the passage of electrical wires 18 therethrough.

Bracket or floor cup 46 is preferably a galvanized steel bracket that has a substantially circular base 102 and four arms 104, 106, 108 and 110 extending therefrom. Base 102 has a hole or aperture 112 in about the center for extending electrical wires 18 therethrough and two holes 116 at the outer edge for extending telecommunication wires 32 therethrough. Additionally, bracket 46 has at least four holes 119 for screws 120 and two holes 121 for screws 122 and can be rigidly coupled to insulator 44 using any means known in the art, such as screws, glue or any other mechanical or chemical connections. Arms 104, 106, 108 and 110 each extend substantially perpendicular to base 102 and have extensions 124, 126, 128 and 130, respectively. The extensions extend substantially perpendicular to the arms and, therefore parallel to base 102. Extensions 124 and 128 are slightly larger then extensions 126 and 130, and extensions 124 and 128 have at least one hole 132 and 134, respectively therein for receiving screws 136 and 138, respectively.

Positioning clips 48 are preferably tapered or pointed metal tabs that screw into bracket 46. The pointed tabs are sized and adapted to engage the surface 16 of opening 12. However, the combination of bracket 46 and clips 23 may be any device or devices known in the art that could couple to any member of the poke through fitting and position and hold poke through fitting 10 in opening 12.

Intumescent rings or discs 50 are preferably a circular fire barrier as is known in the art. Preferably there are two intumescent rings 50, but there may be any number of rings, such as one or three or more. Rings 50 expand radially outwardly and radially inwardly, when exposed to a predetermined amount of heat, to contact surface 16 of aperture 12 to prevent heat, smoke, and flame from passing through aperture 12 in or around poke through fitting 10. Each of the two intumescent rings can have two knock out portions or preferably, the rings may be precut with apertures or openings 140 and 142 extending therethrough, but can also have no apertures, requiring drilling or forming a hole in the rings during installation. The knock out portions are removed when installed, to allow an installer to produce a hole through the rings 50 that is about the same size as the wires passing therethrough.

As seen in FIGS. 3 and 6, wiring tube or conduit 52 is preferably a cylindrical metal tube and has a first end 144, a second end 146, an exterior surface 148, and a through passageway 139. Conduit 52 is preferably approximately ⅞ inches in diameter, but can be any size desired to fit in opening 12. First end 144 has an upper disk 150 extending radially outwardly therefrom and substantially perpendicularly from exterior surface 148. Upper disk 150 is preferably unitary with conduit 52 but can be coupled thereto by any means desired. Upper disk 150 preferably has four holes or apertures 152 therethrough for passing wires 32 and four holes 153 therethrough for passage of screws 120.

As seen in FIG. 3, intumescent rings 54*a*, 54*b*, 54*c* are preferably any configuration desired as long as there is an aperture or opening 154 that is substantially in the center. For example, the rings can be substantially circular (54*a*), substantially circular with two projections (54*b*) or X-shaped (54*c*), or any other configuration desired. Additionally, rings 54*a–c* can have apertures for passing wires therethrough or they can be configured to allow wires to pass around them.

As seen in FIGS. 3 and 4, lower cup 56 and telecom conduits 58 are preferably steel tubes that channel the telecom wires and are coupled to the wiring tube with a bracket or any other desirable method. Cup 56 and conduits 58 can be any material or configuration desired that would help maintain the telecommunication wires in an orderly manner.

Assembly

To assemble the fitting 10, as seen in FIG. 3, bracket 46, intumescent rings 50 and upper disk 150 of wire tube 52 are all secured or rigidly coupled together by screws 120 and form a passageway for electrical wires 18, as is known in the art. Flange 38 is then coupled to bracket 46 by inserting screws 122 through holes 64 and into holes 121 in extensions 124 and 128 of bracket 46. Positioning clips 48 are attached or secured to bracket 46 by extending screws 136 and 138 through the positioning clips and into holes 132 and 134 in extensions 124 and 128, respectively. Bracket 46, in conjunction with positioning clips 48, locate and secure poke through fitting 10 within bore 12 at the top of floor 14, as seen specifically in FIG. 4. Bottom portion 72 of housing 40 is secured to insulator 44 in any manner desired, such as via screws, glue or any other method. Top portion 70 and bottom portion 72 of housing 40 are secured together and the housing is secured to bracket 46 by screws 79 passing through holes 77 of the housing 40 and into bracket 46. Cover 42 is then placed over housing 40 and secured to flange 38 using screws 100. Intumescent rings 54*a–c* are then coupled to conduit 52, preferably by an interference fit or in any manner known in the art. Lower cup 56 and conduits 58 are coupled to wiring conduit 52 using a bracket or any other means desired.

Once the major components of the poke through fitting 10 are assembled, jacks 22 are coupled into apertures 84, so that at least a portion of the jack can extend into or can be received within the aperture 12. Protrusions 85 and latching mechanisms 87 couple to the outer portion and releasable hold the jacks in the apertures 84.

As seen in FIG., 4, fitting 10 is inserted into opening 12 in floor 14, diameter C of fitting 10 extending to about diameter D of opening 12. However, flange 38 has a diameter greater than the diameter D of opening 12, and therefore outer portion 66 rests on floor 14 or carpet 24, holding fitting 10 within opening 12. Positioning clips 48 engage the surface 16 of opening 12 and position and hold fitting 10 substantially centered within and substantially static relative to the opening 12 and floor 14, and preferably substantially perpendicular to floor 14.

Electrical wires 18 and telecommunication wires 32 are pulled from second side 28 of the floor or from underneath the floor, through the intumescent rings 54*a–c*, the cup 56 and conduits 58, through passageway 139 of wiring conduit 52, intumescent rings 50, and bracket 48 and are coupled to the bus bars and the telecommunication jacks, respectively, which face the first side 26 of the floor. Additionally, wires 18 and 32 can be passed through the fitting from the opposite direction (i.e., from the first side of the floor through the fitting and to the second side of the floor). Wires 18 and 32 are coupled to a power source (not shown) on the second side of the floor and to a receiving device (not shown), such as a telephone, computer, telecommunication device, power outlet or any other electrical or non-electrical device on the first side of the floor.

While a specific embodiment has been chosen to illustrate the invention, it will be understood by those skilled in the art that various changes and modifications can be made therein without departing from the scope of the invention as defined in the appended claims.

What is claimed is:

1. A poke through fitting extending through about a four inch diameter aperture in a floor, comprising:

a housing having a top surface, a portion of said housing received within the about four inch diameter aperture in the floor;

at least three electrical outlets received within said housing, each of said outlets being accessible through at least one access opening in said top surface of said housing; and at least five telecommunication jacks coupled to said housing.

2. A poke through fitting according to claim 1, wherein said at least three electrical outlets include at least four electrical outlets; and said at least five telecommunication jacks include at least eight telecommunication jacks.

3. A poke through fitting according to claim 1, wherein a portion of each of said at least five telecommunication jacks is received within the aperture in the floor.

4. A poke through fitting according to claim 1, wherein said at least five telecommunication outlets are arranged around a perimeter of said housing.

5. A poke through according to claim 1, wherein said housing includes a plurality of extensions extending radially outwardly from an outer surface of said housing, said at least five telecommunication jacks adapted to couple to said extensions.

6. A poke through fitting according to claim 1, wherein said at least three electrical outlets are arranged closer to the center of the housing than said at least five telecommunication outlets.

7. A poke through fitting according to claim 1, wherein said at least five telecommunication outlets each have a plug portion and a back portion, each of said back portions having a cross-sectional area that is less than a cross-sectional area of said plug portion.

8. A poke through fitting according to claim 1, wherein said housing is low profile.

9. A poke through fitting according to claim 3, wherein said housing does not extend more than about 0.6 inches above the floor.

10. A low profile electrical fitting extending through about a four inch diameter aperture in a floor, comprising:

a housing having a top surface and a bottom surface, said bottom surface extending at least partially into the about four inch diameter aperture in the floor;

at least six telecommunication jacks coupled to said housing;

four electrical outlets received within said housing, each of said outlets being accessible through said top surface of said housing; and a cover coupled to said housing, said cover having a substantially planar surface that is generally parallel with the floor;

said four electrical outlets having an uppermost surface and said at least six telecommunication jacks having an uppermost surface, said uppermost surfaces of said four electrical outlets and said at least six telecommunication jacks being generally parallel with the floor and extending in about the same plane as said substantially planar surface of said cover.

11. A low profile electrical fitting according to claim 10, wherein said at least six telecommunication jacks include at least eight telecommunication jacks.

12. A low profile electrical fitting according to claim 10, wherein said cover does not extend more than about 0.6 inches above the floor.

13. A low profile electrical fitting according to claim 10, wherein a portion of each of said at least six telecommunication jacks is received within the aperture in the floor.

14. A low profile electrical fitting according to claim 10, wherein said at least six telecommunication outlets are arranged adjacent a perimeter of said housing.

15. A low profile electrical fitting according to claim 10, wherein said at least four electrical outlets are arranged closer to the center of the top portion than said at least six telecommunication outlets.

16. A low profile electrical fitting according to claim 10, wherein said at least six telecommunication jacks are adapted to couple to extensions, said extensions protruding radially outwardly from an outer surface of said housing.

17. A low profile electrical fitting according to claim 16, wherein each of said extensions is adapted to couple to two telecommunication jacks.

18. A low profile poke through fitting extending through about a four inch diameter aperture in a floor, comprising:

a housing having a top surface, a portion of said housing received within the about four inch diameter aperture in the floor;

eight telecommunication jacks coupled to said housing and arranged adjacent the perimeter of said housing, a portion of each of said eight telecommunication jacks being received within the aperture in the floor;

four electrical outlets received within said housing, each of said four electrical outlets being accessibly through said top surface of said housing;

a cover coupled to said housing, said cover having a substantially planar surface that is generally parallel with the floor;

a tubular wiring conduit coupled to said housing; and at least one substantially ring-shaped intumescent fire barrier coupled to said wiring unit;

said four electrical outlets having an uppermost surface and said eight telecommunication jacks having an uppermost surface, said uppermost surfaces of said electrical outlets and said telecommunication jacks being generally parallel with the floor and extending in about the same plane as said top substantially planar surface of said cover.

19. A low profile poke through fitting according to claim 18, wherein said cover does not extend more than about 0.6 inches above the floor.

20. A low profile poke through fitting according to claim 18, wherein said eight telecommunication outlets are arranged adjacent a perimeter of said housing.

21. A low profile poke through fitting according to claim 18, wherein said eight telecommunication jacks are adapted to couple to extensions, said extensions protruding radially outwardly from an outer surface of said housing.

22. A low profile poke through fitting according to claim 21, wherein each of said extensions is adapted to couple to two telecommunication jacks, and each of said extensions is substantially equally spaced from an adjacent extension.

23. A low profile poke through fitting, comprising:

a housing having a central axis;

a substantially circular array of electrical outlets coupled to said housing and having a center substantially aligned with said central axis of said housing; and a substantially circular array of telecommunication jacks coupled to said housing, having a center substantially aligned with said central axis of said housing, and being spaced radially farther from said central axis than said circular array of electrical outlets, wherein two telecommunication jacks are positioned between each adjacent electrical outlet.

24. A low profile poke through fitting according to claim 23, wherein said circular array of electrical outlets comprises at least three electrical outlets; and said circular array of telecommunication jacks comprises at least five telecommunication jacks.

25. A low profile poke through fitting according to claim 23, wherein upper portions of said circular array of electrical outlets and telecommunication jacks are contained in substantially the same plane.

26. A poke through fitting, comprising a housing having a top surface with an inner portion and an outer portion;

a first electrical outlet being located at least partially within said inner portion and having a first radial line extending from a center of the top surface though said first electrical outlet;

a second electrical outlet being located at least partially within said inner portion and having a second radial line extending from said center axis though said second electrical outlet, said first and second electrical outlets being adjacent to each other and said first and second radial lines defining a first segment in said top surface, said first segment spanning less than 180°; and at least two telecommunication jacks being located in between said first and second electrical outlets in said first segment.

27. A poke through fitting according to claim 26, wherein said first segment is approximately 90 degrees.

28. A poke through fitting according to claim 26, further comprising a third electrical outlet being located at least partially within said inner portion and having a third radial line extending from said center of said top surface though said third electrical outlet;

and a fourth electrical outlet being located at least partially within said inner portion and having a fourth radial line extending from said center of said top surface though said fourth electrical outlet;

said first, second, third and fourth radial lines defining said first segment and a second, third and fourth segment; and at least two telecommunication jacks located within each of said second, third and fourth segments.

29. A poke through fitting extending through an aperture in a floor, comprising:

a housing having a top surface and a central axis, a portion of said housing received within the aperture in the floor;

at least three electrical outlets received within said housing, each of said outlets being accessible through at least one access opening in said top surface of said housing; and at least five telecommunication jacks coupled to said housing, at least a portion of each jack being located within about two inches from the central axis of said housing.

30. A low profile electrical fitting extending through an aperture in a floor, comprising:

a housing having a top surface, a bottom surface and a central axis, said bottom surface extending at least partially into the aperture in the floor;

at least six telecommunication jacks coupled to said housing, at least a portion of each said jack being located within about two inches from the central axis of said housing;

four electrical outlets received within said housing, each of said outlets being accessible through said top surface of said housing; and a cover coupled to said housing, said cover having a substantially planar surface that is generally parallel with the floor;

said four electrical outlets having an uppermost surface and said at least six telecommunication jacks having an uppermost surface, said uppermost surfaces of said four electrical outlets and said at least six telecommunication jacks being generally parallel with the floor and extending in about the same plane as said substantially planar surface of said cover.

31. A low profile poke through fitting extending through an aperture in a floor, comprising:

a housing having a top surface and a central axis, a portion of said housing received within the aperture in the floor;

eight telecommunication jacks coupled to said housing and arranged adjacent the perimeter of said housing, a first portion of each of said eight telecommunication jacks being received within the aperture in the floor and at least a second portion of each said jack being located within about two inches from the central axis of said housing;

four electrical outlets received within said housing, each of said four electrical outlets being accessibly through said top surface of said housing;

a cover coupled to said housing, said cover having a substantially planar surface that is generally parallel with the floor;

a tubular wiring conduit coupled to said housing; and at least one substantially ring-shaped intumescent fire barrier coupled to said wiring unit;

said four electrical outlets having an uppermost surface and said eight telecommunication jacks having an uppermost surface, said uppermost surfaces of said electrical outlets and said telecommunication jacks being generally parallel with the floor and extending in about the same plane as said top substantially planar surface of said cover.

* * * * *